US005733021A

United States Patent [19]

O'Neill et al.

[11] Patent Number: 5,733,021

[45] Date of Patent: Mar. 31, 1998

[54] THEFT-RESISTANT DISPLAY CASE

[75] Inventors: Brian K. O'Neill; Dennis R. Pound, both of Cape Coral, Fla.

[73] Assignee: Tampco Fixture Group, Inc., Fort Myers, Fla.

[21] Appl. No.: 675,793

[22] Filed: Jul. 5, 1996

[51] Int. Cl.[6] ..... A47F 3/00

[52] U.S. Cl. ..... 312/114; 312/138.1; 312/312

[58] Field of Search ..... 312/114, 21, 204, 312/117, 139.1, 138.1, 291, 319.5, 319.8, 312, 313, 323, 196, 310, 290; 277/53

[56] References Cited

U.S. PATENT DOCUMENTS

| | | | |
|---|---|---|---|
| 542,475 | 8/1895 | Hoare | 312/114 |
| 1,544,218 | 6/1925 | Champion | 312/117 X |
| 2,068,591 | 1/1937 | Bennett | 312/138.1 X |
| 2,284,531 | 5/1942 | Miller et al. | 312/310 |
| 2,569,254 | 9/1951 | Page | 312/310 X |
| 2,576,888 | 11/1951 | Padgett | 312/312 X |
| 2,655,419 | 10/1953 | Achs | 312/138.1 X |
| 4,929,862 | 5/1990 | Hamilton et al. | 312/138.1 |
| 5,129,611 | 7/1992 | Grover et al. | 312/312 X |
| 5,201,530 | 4/1993 | Kelch et al. | 277/53 |

FOREIGN PATENT DOCUMENTS

| | | | |
|---|---|---|---|
| 6090831 | 4/1994 | Japan | 312/204 |

*Primary Examiner*—Peter M. Cuomo
*Assistant Examiner*—Janet M. Wilkens
*Attorney, Agent, or Firm*—William E. Noonan

[57] ABSTRACT

A theft-resistant display case includes a housing having a lower storage section and an upper display section mounted above the storage section. The storage section has an obscuring exterior wall and the display section has an exterior wall that is at least partly transparent. A platform is movably mounted within the housing for supporting items to be displayed. The platform is selectively raised into a first position in the housing wherein items supported on the platform are displayed in the upper section of the housing. The platform is selectively lowered into a second position in the housing wherein items supported on the platform are stored in the lower section of the housing. An obscuring closure is selectively interposed between the upper and lower sections when the platform is in the second position such that the platform and items supported thereon are enclosed within the lower section of the housing and hidden from view.

20 Claims, 7 Drawing Sheets

THEFT-RESISTANT DISPLAY CASE

FIELD OF THE INVENTION

This invention relates to a theft-resistant display case and, more particularly, to a case for displaying jewelry and other valuable merchandise during normal business hours and for automatically moving such merchandise out of view and storing it in a locked condition during after-business hours.

BACKGROUND OF THE INVENTION

Display cases are widely employed by both department stores and smaller retailers for displaying a wide variety of merchandise. Glass and mirrored display cases are commonly used to feature fine jewelry, coins and other valuable items. Unfortunately, most conventional cases are extremely susceptible to theft and burglary. Accordingly, security precautions require that valuable merchandise be removed from the display case nightly, following the close of business and placed in a safe, vault or other secure, locked location. The following morning, the merchandise must be moved back into the case.

Constantly filling and emptying the display case with merchandise is both tedious and time consuming. Additionally, constantly moving the merchandise between the display case and safe or other locked location increases the risk that items will be lost or misplaced. It is impractical however, to leave valuable merchandise in most standard display cases overnight. Although such cases can be secured by a variety of locks, they usually comprise a glass construction that is easily broken and penetrated by both experienced and inexperienced thieves. Alarms are also readily bypassed by skilled burglars.

At present, there exists a significant need for a relatively simple and inexpensive display case that serves both to display jewelry and other valuable merchandise in an attractive manner and to securely guard such merchandise in a hidden and locked condition during after-business hours.

SUMMARY OF INVENTION

It is therefore an object of this invention to provide an improved, theft-resistant display case that safely and securely holds valuable merchandise in a locked and hidden condition during after-business hours.

It is a further object of this invention to provide a theft-resistant display case having a relatively simple and easy to operate construction that is affordable to retailers of all sizes.

It is a further object of this invention to provide a theft-resistant display case that securely holds valuable merchandise within the case, both during and after normal business hours so that the case does not have to be emptied and refilled on a daily basis.

It is a further object of this invention to provide a theft-resistant display case that eliminates the time, tedium and labor normally required to empty and restock display cases on a daily basis.

It is a further object of this invention to provide a theft-resistant display case that eliminates the need for a separate safe, vault or other locked location to store valuable merchandise during after-business hours.

It is a further object of this invention to provide a theft-resistant display case that is difficult for a thief to penetrate.

It is a further object of this invention to provide a theft-resistant display case that is relatively easy for store personnel to use and operate.

It is a further object of this invention to provide a theft-resistant display case that permits valuable merchandise to be quickly and conveniently removed from view and securely stored during after business hours and at other times when required.

It is a further object of this invention to provide a theft-resistant display case that has safety features which prevent accidental damage to the stored merchandise.

This invention features a theft-resistant display case. The case includes a housing having an upper display/section and a lower storage section. The lower storage section has an obscuring exterior wall and the upper display section is mounted above the lower section and has an exterior wall that is at least partly transparent. A platform is movably mounted within the housing for supporting items to be displayed. There are means for selectively raising the platform into a first position in the housing wherein items supported on the platform are displayed in the upper section of the housing and lowering the platform into a second position in the housing wherein items supported on the platform are stored in the lower section of the housing. An obscuring closure is selectively interposed between the upper and lower sections when the platform is in the second position. As a result, the platform and the items supported thereon are enclosed within the lower section of the housing and hidden from view.

In a preferred embodiment, the case includes means for removably supporting the closure in the interposed condition in the housing between the upper and lower sections. The housing may include a slot through which the closure is selectively interposed and at least partly removed from between the upper and lower sections of the housing. The closure may include hingedly interconnected forward and rearward members that are selectively alternated between a substantially coplanar condition wherein the closure may be interposed through the slot between the upper and lower sections of the housing and a second angled condition wherein said rearward closure member is removed through the slot from between the upper and lower sections of the housing and pivoted downwardly relative to the forward member into a position against the exterior wall of the lower section of the housing. The means for removably supporting may include two sets of rollers carried by one of the closure and the housing and two complementary tracks carried by the other of the closure and the housing. Each track is operably engaged with a respective set of rollers such that the closure is selectively interposed and removed from between the upper and lower sections. Preferably, the tracks are mounted to the housing along respective side of the closure and each set of rollers is carried by the forward and rearward closure members along a respective side of the closure.

Means may be provided for locking the closure in the interposed condition. In particular, a lock may be mounted in the housing above the slot and the rearward member of the closure may carry a latch that is selectively engaged by the lock to hold the closure in the interposed condition. A security plate may be carried by the rearward member of the closure. That plate blocks access to the lock through the slot when the enclosure is in its interposed condition.

Switch means may be responsive to the closure being interposed between the upper and lower sections of the housing for preventing the platform from being raised. Flexible sweep means may interengage the platform and the housing for preventing items supported on the platform from passing between the platform and the housing and for permitting the platform to be raised and lowered within the housing. The means for raising and lowering may include an electrically powered lift apparatus contained within the lower section of the housing.

The lower section of the housing may include an outer shell and an inner liner that is less penetrable than the outer shell to reduce access into the lower section of the housing.

BRIEF DESCRIPTION OF THE DRAWINGS

Other objects, features and advantages will occur from the following description of preferred embodiments and the accompanying drawings, in which.

DETAILED DESCRIPTION OF PREFERRED EMBODIMENTS

Figure 1:
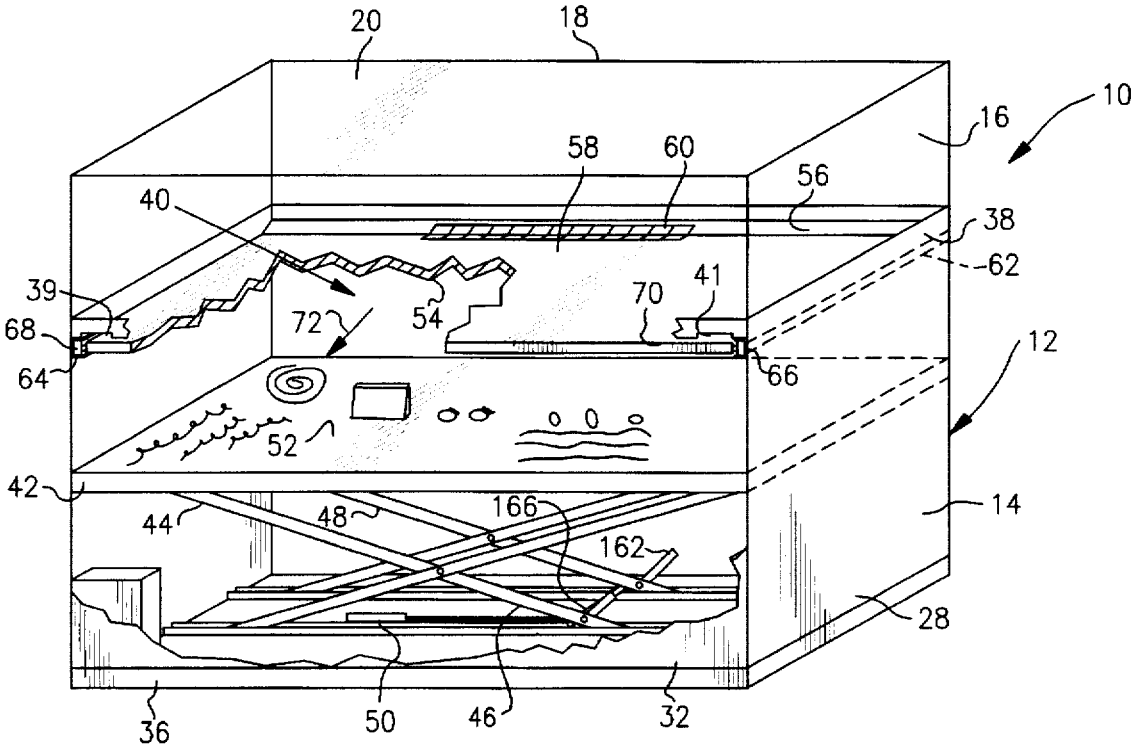
FIG. 1 is a perspective, partly cut away view of a preferred theft-resistant display case according to this invention.
Figure 2:
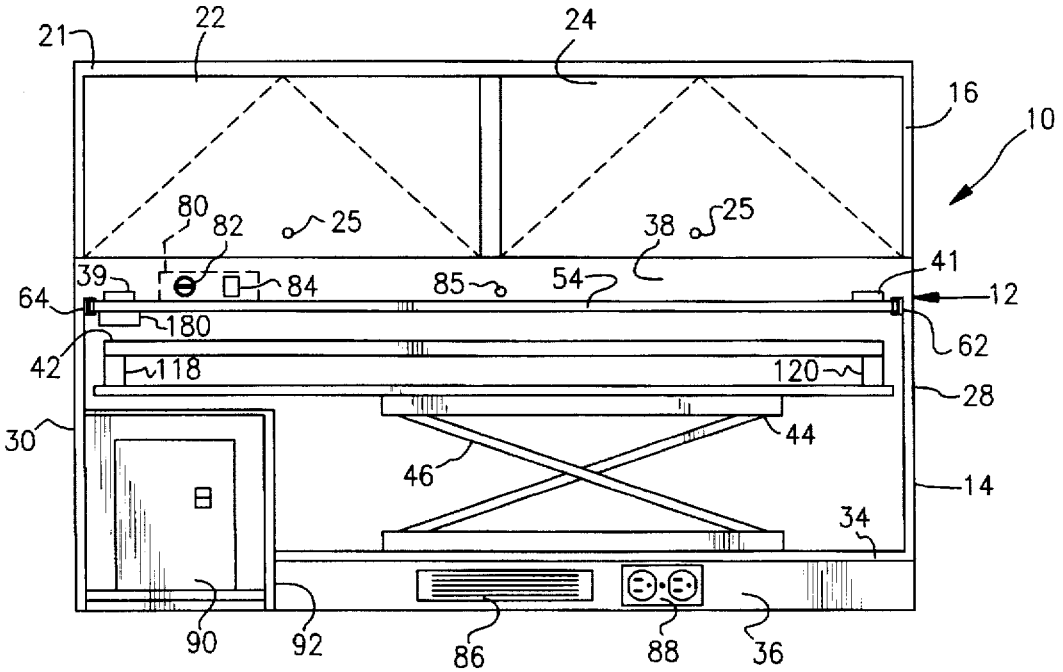
FIG. 2 is an elevational rear view of the display case with the back wall of the lower section omitted to illustrate an alternative preferred lift apparatus and battery back-up.
Figure 3:
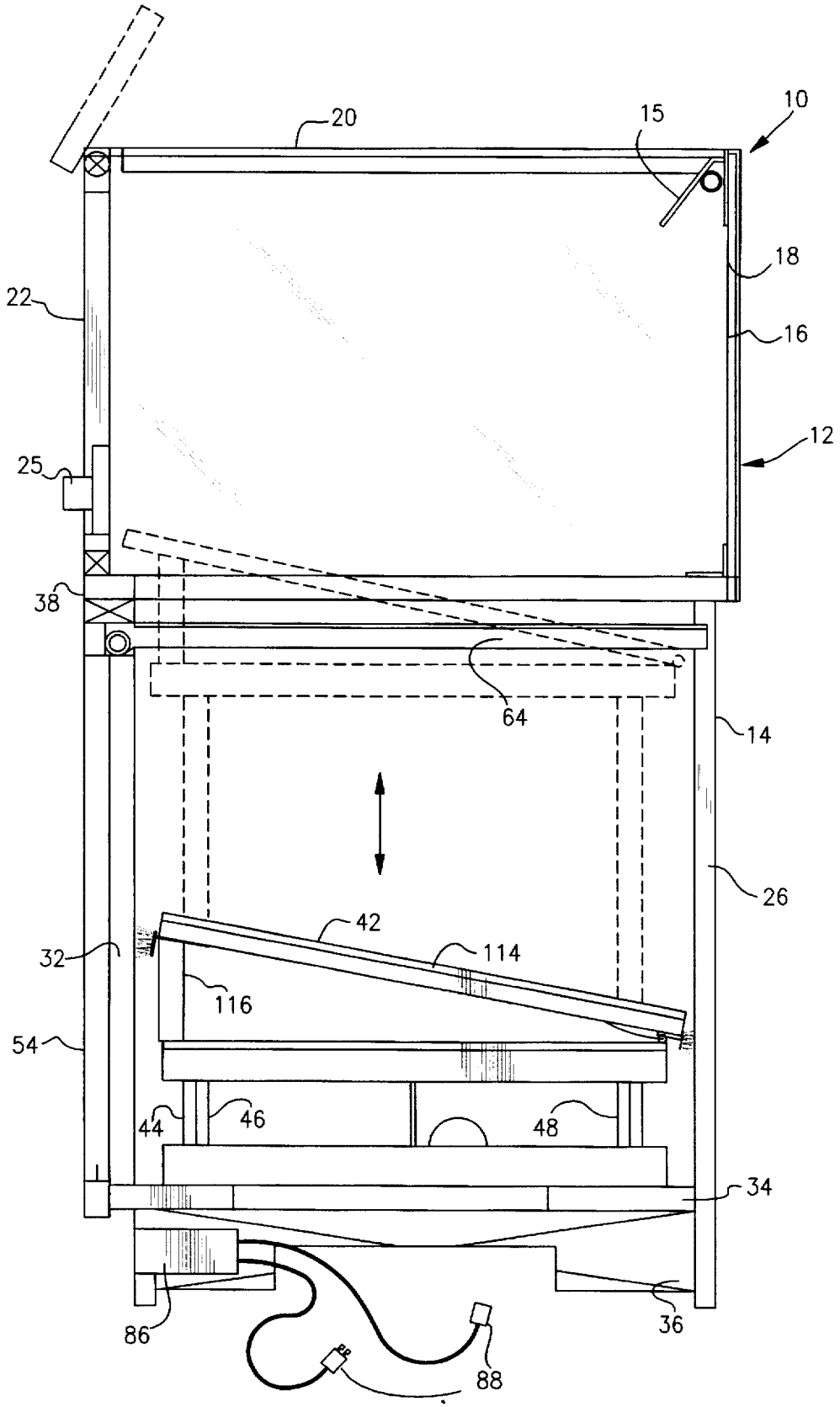
FIG. 3 is an elevational side view of the display case with the wall of the lower section omitted to illustrate the lift and the support platform the closure is shown in a open condition.
Figure 7:
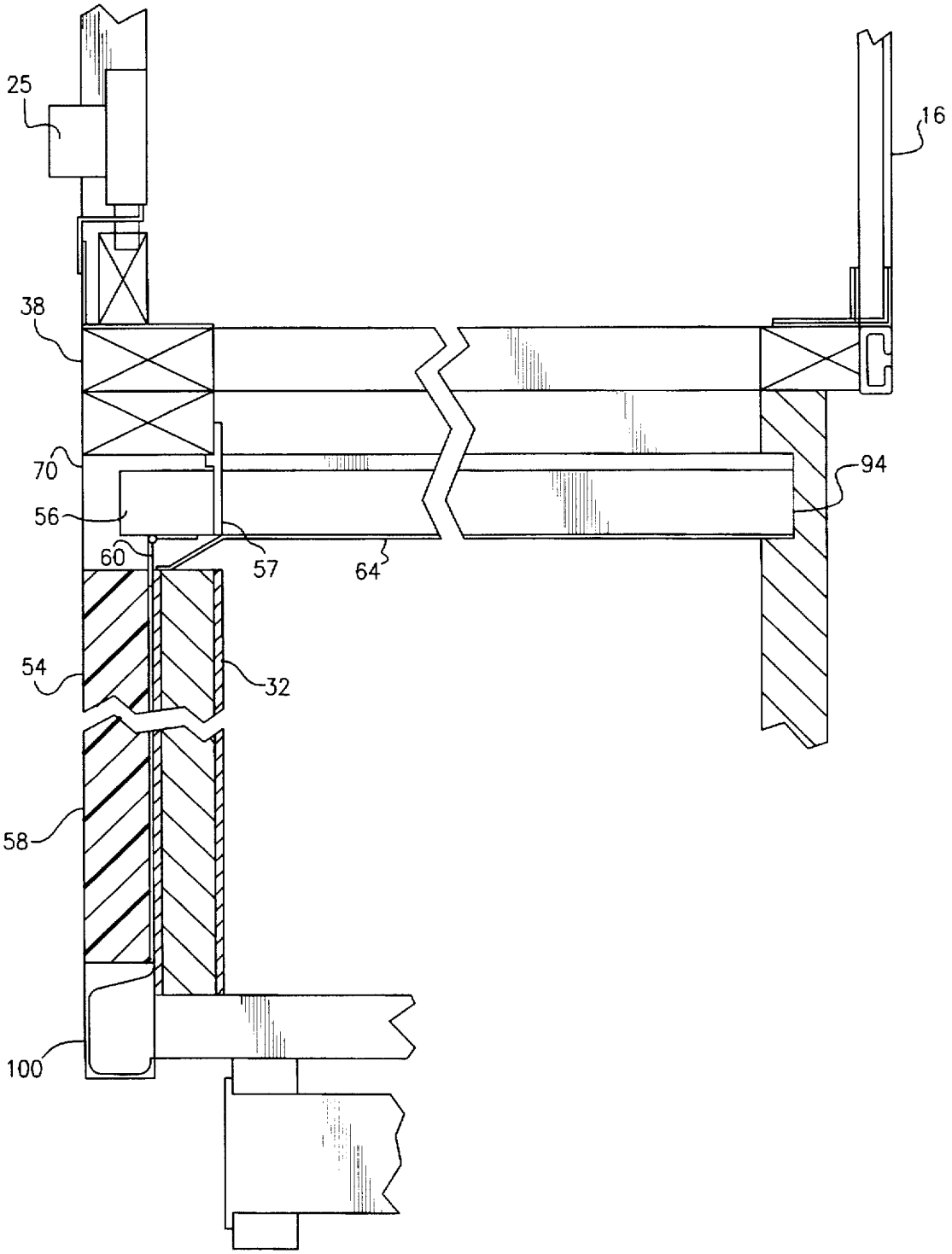
FIG. 7 is an elevational, cross sectional view of the display case, with the closure in an open position.

There is shown in FIGS. 1–3 a display case 10 comprising a housing 12 having a lower section 14 and an upper section 16. Upper section 16 typically features a conventional display case construction and includes one or more transparent glass walls. At the very least, the front wall 18 and the upper wall 20 are transparent. The remaining walls of upper section 16 may be either fully transparent or interiorly lined with mirrors or an opaque material, as desired. As best shown in FIG. 3, a lamp 15 may be mounted within the upper housing section. The walls of upper section 16 may be joined together by an appropriate metal frame 21 or other standard display case structure. As specifically shown in FIG. 2, access into upper section 16 may be provided through a pair of hingedly attached display doors 22 and 24 formed in the rear of the case. Each door has a lock 25 mortised to the inside surface thereof. This lock, shown specifically in FIGS. 2, 3 and 7, is selectively operated to lock a respective one of the doors closed. In alternative embodiments, one or more sliding doors may be provided in the rear wall of upper section 16. The remaining details of the upper section are well known to those skilled in the art of display cases and do not comprise a part of this invention.

Lower housing section 14 is defined by four interconnected exterior walls 26, 28, 30 and 32 that form the front, sides and rear of the housing, respectively. The exterior walls surround a floor 34 that is disposed above a base 36. The upper edge of lower section 14 carries a peripheral rail portion 38 that extends about the display case and defines the lower boundary of upper section 16. The upper section is mounted to lower section 14 in a conventional manner. The exterior walls that form lower section 14 are composed of a suitable wood or wood laminate material. Alternatively, fiberglass and various synthetic structural components can be used. In various embodiments, the walls may be attached to an interior metal framework. It is important that the lower section walls be obscuring. This means that they are opaque or otherwise non-transparent so that merchandise can be effectively stored within lower section 14 and obscured from view after business hours. Although the display case has a generally rectangular cross sectional shape, it should be understood that various alternative shapes may be employed.

Housing sections 14 and 16 define an interior compartment 40, FIG. 1. A merchandise display platform 42 is mounted within compartment 40 on one of a variety of scissor jack lift 44. The lifts is itself supported on floor 34 of lower housing section 14. Lift 44 includes a pair of scissor components 46 and 48 that are operated by a motor 50, in a manner described more fully below, to selectively raise and lower platform 42 within housing 12. In FIG. 2, a simplified, somewhat more compact version of lift 44 is depicted. Indeed, in the respective drawings, various embodiments of the lift and platform are shown. These embodiments may be freely interchanged and substituted for one another within the scope of this invention.

As best shown in FIGS. 2 and 3, platform 42 is sloped downwardly from back to front so that merchandise 52 supported by the platform is properly displayed through the transparent walls of upper section 16 when the platform is in the raised position within housing 12. The platform may be mounted to lift 44 by bolts, fasteners or other appropriate means of attachment that should be understood to those skilled in the art. It should be noted that various types of lifts and elevator mechanisms may be employed to selectively raise and lower the platform. The invention is not limited to the scissor jack lifts depicted in the drawings.

In FIGS. 1–3, lift 44 and platform 42 are illustrated in a lowered condition wherein the platform and displayed merchandise 52 are disposed fully within lower housing section 14. The upper and lower sections of housing 12 are separated by an obscuring closure 54 that is selectively interposed between lower housing section 14 and upper housing section 16. Closure 54 includes a pair of generally planar components that are substantially opaque or otherwise non-transparent. In particular, the closure includes an elongate, relatively narrow, forward member 56 and a much larger rearward member 58 that is foldably attached to forward member 56 by a piano hinge or other pivot means 60. The closure is held within housing 12 by a pair of tracks 62 and 64 that are mounted to the interior sides of the housing and extend front to back along respective side walls 28 and 30.

The sides of closure 54 carry sets of rollers 66 and 68 that engage tracks 62 and 64, respectively, in a manner described more fully below. As a result, the closure is mounted within the housing and divides compartment 40 into upper and lower sections 16 and 14. Rearward wall 32 includes an elongate slot 70, partially shown in FIG. 1 and best illustrated in FIG. 4. Slot 70 is formed immediately below rail 38. Closure 54 is selectively introduced into and removed from housing 12 through slot 70. Rollers 66 and 68 permit rearward closure member 58 to be pulled out of housing 12 by pulling closure 54 rearwardly in the direction of arrow 72, FIG. 1. This operation, which is described in greater detail below, permits platform 42 to be selectively exposed so that the lift can be raised within housing compartment 40. Alternatively, when required, closure 54 can be inserted into the housing, as shown in FIG. 1, to cover and hide platform 42 and merchandise 52 from view during after business hours.

Peripheral rail 38, shown in FIGS. 1–4, comprises a wood or wood laminate material. The rail may be formed unitarily with or separately from the lower housing section. A pair of bracket recesses 39 and 41 are formed in rail 38 immediately above slot 70. These recesses accommodate mounting brackets, not shown, that are pivotally mounted within the rails. The mounting brackets are used to secure a protective cover to the display case. Such a protective cover, likewise not shown, does not comprise a part of this invention. A closure lock 85 is formed centrally in the rearward side of rail 38 just above closure 54. Lock 85 is operated as described below to secure closure 54 in a locked condition shown in FIGS. 1 and 2.

As illustrated in FIG. 2, a switch panel 80 is mounted in rail 38. The switch panel includes an optional power switch lock 82 and a rocker switch 84. The power switch lock is operated by a key to selectively energize and de-energize the display case. Power is supplied to case 10 by a standard AC outlet, not shown. When switch 82 is in a deactivated condition, the case is de-energized. By activating switch lock 82, the case is energized so that lift 44 may be operated. In particular, lift 44 is selectively raised and lowered by properly engaging rocker switch 84. That switch may include up to three positions or states. In one position, the lift is deactivated. In the other two positions power is provided to respectively raise or lower the lift.

Base 36 includes a ballast box 86, FIGS. 2 and 3. This box houses a transformer which operates the lights for display case 10. A standard pair of twist receptacles 88, FIG. 3, permit the case to be electrically interconnected to additional display cases so that power is provided to operate those cases in accordance with this invention. An optional battery back-up 90, FIGS. 1 and 2, is housed in a compartment 92 formed in base 36 and lower housing section 14. Battery back-up 90 serves in a standard manner to provide power to display case 10 in the event of an electrical outage.

Figure 4:
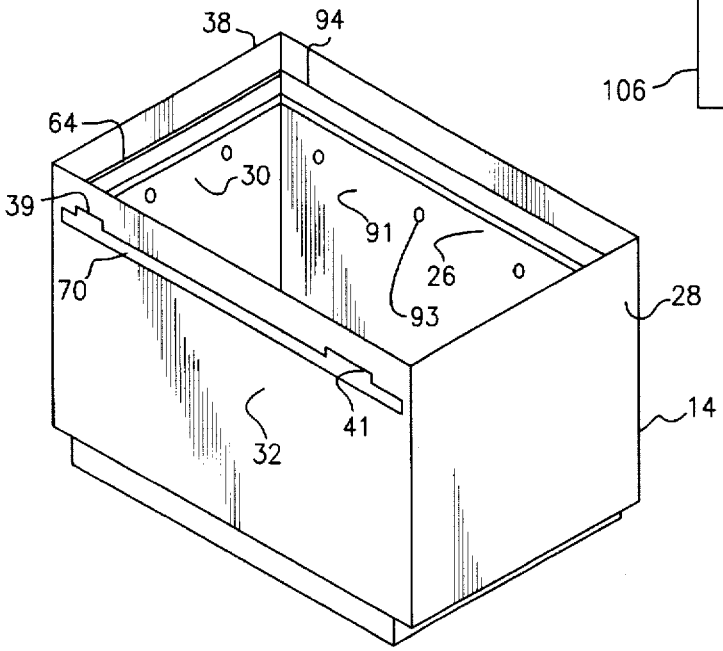
FIG. 4 is a perspective view of the lower section of the display case with the closure omitted to illustrate the inner security lining.

As shown in FIG. 4, walls 26, 28, 30 and 32 are interconnected at right angles. The lower housing section comprises an exterior shell that is composed of a suitable synthetic, wood or wood laminate. An inner liner 91, composed of a relatively impenetrable material such as stainless steel or some other metal or metal alloy, is secured by rivets, bolts or other fasteners 93 to the interior side walls of the exterior shell. This material makes it very difficult, if not impossible, for a thief to cut through the wood or laminate shell of the lower housing section and obtain access to merchandise stored therein. In alternative versions, the shell may be eliminated. It can also comprise separate plates respectively attached to one or more of the walls. Track element 64 and similarly track element 62, which is obscured in FIG. 4, are formed respectively along the inside surfaces of walls 30 and 28. These tracks are attached to the walls by appropriate fasteners. A recess 94 is formed in front wall 26 just above the upper edge of liner 90. Slot 70 is formed in rearward wall 32. Rail 38 is formed peripherally above slot 70, recess 94 and track members 62 and 64. As previously described, the rail element may be formed unitarily with the exterior walls of lower housing section 14. Alternatively, separate wood or laminate components may be utilized for the rail. When closure 54 is interengaged with the housing in the manner shown in FIGS. 1 and 2, it is received though slot 70 and held in tracks 62 and 64. The inner member 56 of closure 54 is received by recess 94. Closure 54 thereby divides the upper and lower sections of housing 12.

Figure 5A:
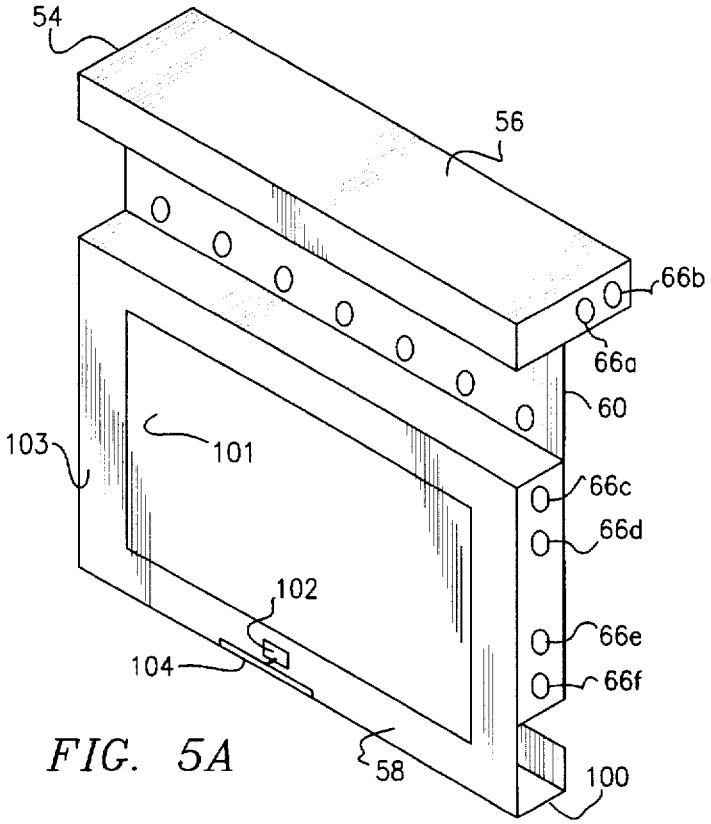
FIG. 5A is a perspective view of the closure when removed from the housing.

Closure 54 is shown alone in FIG. 5A. For clarity, a version of closure 54 having a relatively narrow side to side dimension is illustrated. However, in alternative versions, the closure may have varying widths. Forward closure member 56 carries a pair of rollers **66*a* and 66*b*. A similar pair of rollers are formed along the opposite side of member 56. Likewise, rearward member 58 carries rollers 66*c*, 66*d*, 66*e*, and 66*f*. Similar rollers are formed along the opposite side of member 58. Hinge 60 normally comprises a standard 3" piano hinge having plates that are attached to members 56 and 58, respectively. Hinge 60 allows members 56 and 58 to pivot relative to one another between the generally co-planar condition shown in FIG. 1 and the angled position depicted in FIG. 5, wherein member 58 extends at approximately a 90 degree angle downardly from member 56. A metal or plastic pull handle 100 is carried at the lower distal end of member 58. A latch 102 is formed centrally in member 58 proximate the distal edge thereof. The members 56 and 58 of closure 54 may be composed of various durable, high-strength materials. These may include various woods, wood laminates, metals, or synthetics. In a particularly preferred version, illustrated in FIG. 5A, member 58 comprises a Lexan® element 101 that is bounded by a wood frame 103**. This material is fairly lightweight so that the closure is relatively easy to manipulate. At the same time, this material is extremely rugged and able to withstand great impact forces. As a result, it is very difficult for a thief to break through the closure.

Figure 5C:
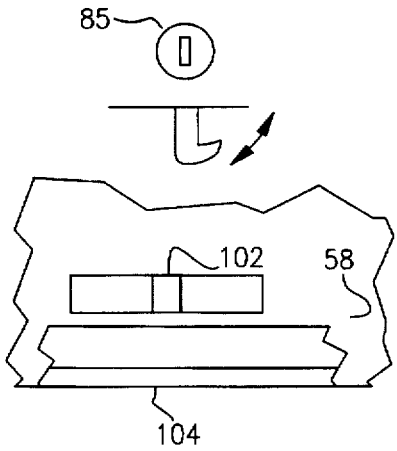
FIG. 5C is an elevational view of the closure lock and latch with the latch turned ninety degrees relative to the lock for clarity.
Figure 5B:
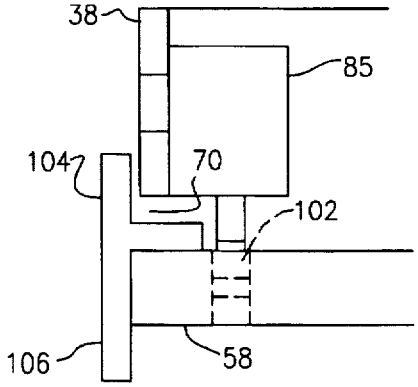
FIG. 5B is a cross sectional view of the lock and latch mechanism for securing the closure, and the plate which restricts access to the lock.

A metal guard 104, also shown in FIGS. 5B and 5C, is secured to the distal end of closure member 58 proximate latch 102. As best shown in FIG. 5B, guard 104 includes a flange 106 that blocks slot 70 when closure 58 is inserted into the housing. This restricts a potential thief's access to latch 102 and lock 85 through slot 70. When closure 58 is fully received in housing 12, lock 85 may be operated to engage latch 102, FIGS. 5B and 5C. This locks the closure in place within the housing.

Because closure 54 is movably mounted in tracks 62 and 64 by sets of rollers 66 and 68 respectively, the closure may be rolled into and out of housing 12 through slot 70. Closure 54 is shown in the interposed condition in FIGS. 1, 2, and 6. In that position, members 56 and 58 of closure 54 are substantially coplanar. The distal end of rearward member 58 is located generally in slot 70. By grasping pull handle 100 and pulling closure 54 outwardly in the direction of arrow 72, the closure is pulled from between lower and upper housing sections 14 and 16. As shown in FIG. 7 and in phantom in FIG. 6, member 58 is pulled completely out of track 64 (and analogously track 62). Forward member 56 is retained within the tracks by a catch 57. Member 58 is then permitted to pivot downardly about hinge 60, as indicated by the double-headed arrows in FIG. 6, until member 58 lays against the outside of wall 32, FIGS. 6 and 7. As a result, lower and upper housing sections 14 and 16 are in full communication. This permits platform 42 to move from the lower to the upper housing section and vice versa, as required.

Figure 8:
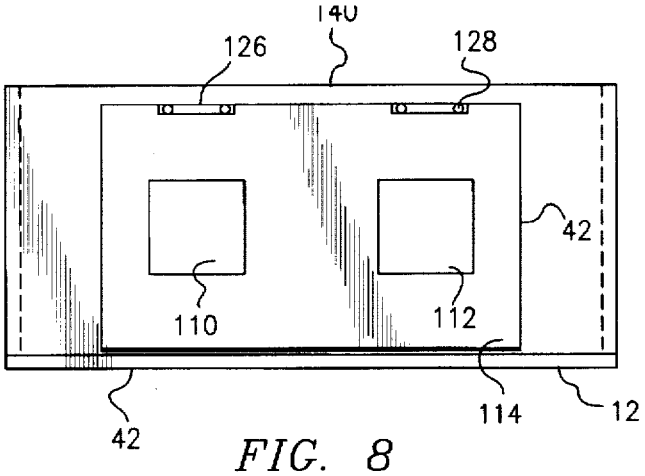
FIG. 8 is a plan view of the platform.
Figure 9:
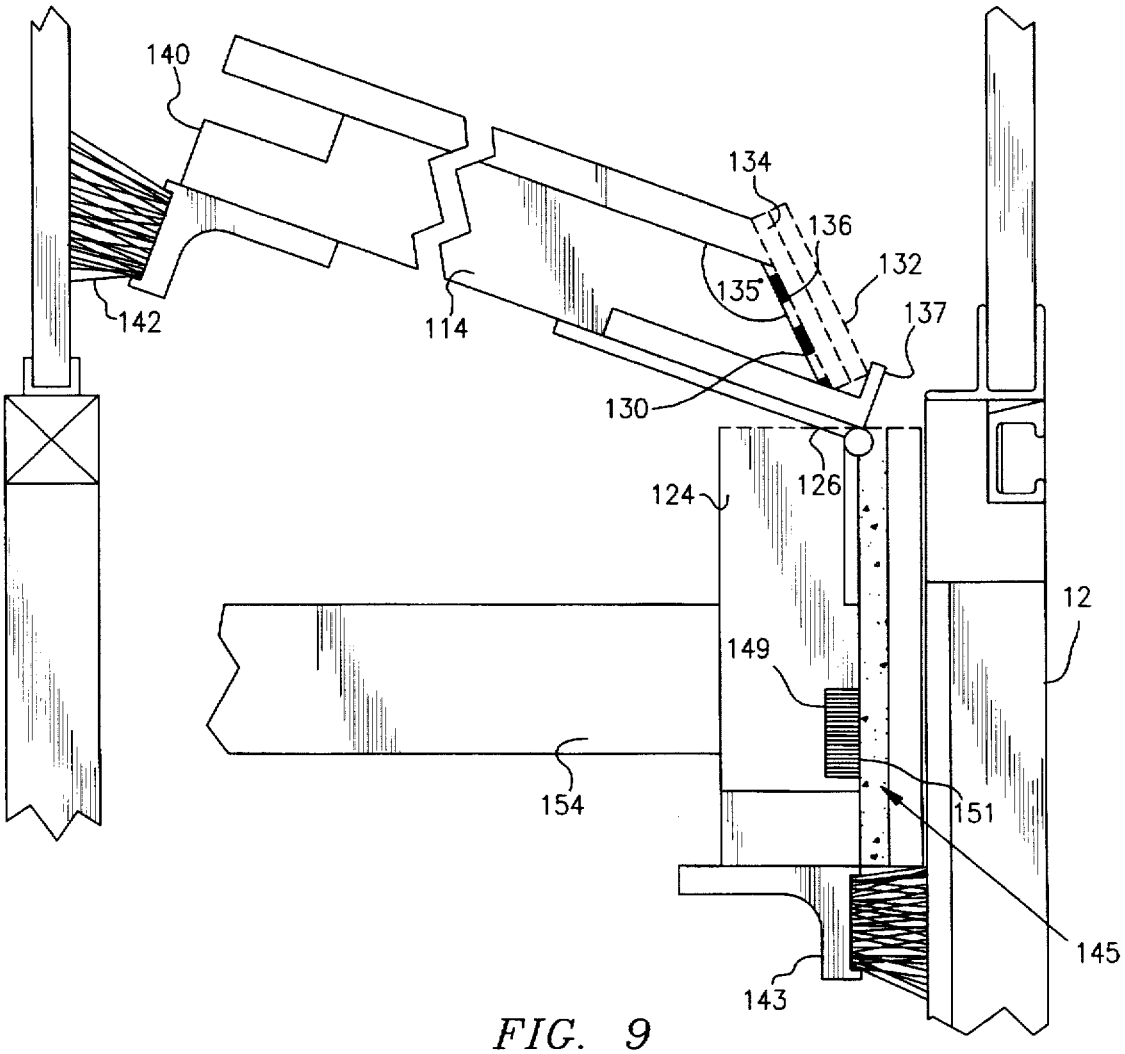
FIG. 9 is an elevational, cross sectional view of the platform.

Platform 42 is illustrated in greater detail in FIGS. 8 and 9. The platform may have various sizes designed to fit differing sizes of display cases. A pair of access holes 110 and 112 are formed through platform 42. These provide access to the lift and other electrical and mechanical components of the display case so that necessary repairs can be performed.

The platform includes a generally rectangular planar portion 114 that is mounted at an incline to lift 44, in the manner shown in FIG. 3. This incline may be achieved by a longitudinal support block 116. Alternatively, as shown in FIG. 2, wedge-shaped blocks 118 and 120 may be employed to achieve the necessary incline. Platform 42 includes a depending portion 124, FIG. 9, that is hingedly secured to planar portion 114 by a pair of hinges 126 and 128, FIGS. 8 and 9 and to upper frame 154 of lift 44. A beveled portion 130 is formed at the leading edge of planar section 114. Beveled position 130 includes an angled surface that extends at an angle of about 135 degrees from the upper surface of section 114. An appropriate commercial sign band 132 may be secured to a Masonite™ strip 134 that is itself attached to the beveled surface by means of a hook and loop fastener 136. The bottom edge of the sign is retained by an L-shaped molding 137.

An elongate brush element 142 is carried about the side edges (not shown) and rear peripheral edge 140 of platform 114. A similar brush element 143 is carried by depending portion 124. A thin, fabric covered Masonite™ strip 145 is removably attached to portion 124 by complementary magnetic components 149, 151 recessed in portion 124 and strip 145, respectively. As the platform is elevated into the raised condition, shown in FIG. 9, brush component 142 engages the inside walls of housing 12. As a result, the brush component blocks the gap between the periphery of the platform and the inner walls of the housing. This prevents jewelry and other valuable merchandise from accidentally slipping through that gap and into the lower section 14 of housing 12.

The hinged structure shown in FIG. 9 permits portion 114 of platform 42 to adjust to a flat or angled position, as required, for displaying merchandise. Portion 114 may even be pivoted vertically to provide access below the platform.

Figure 10:
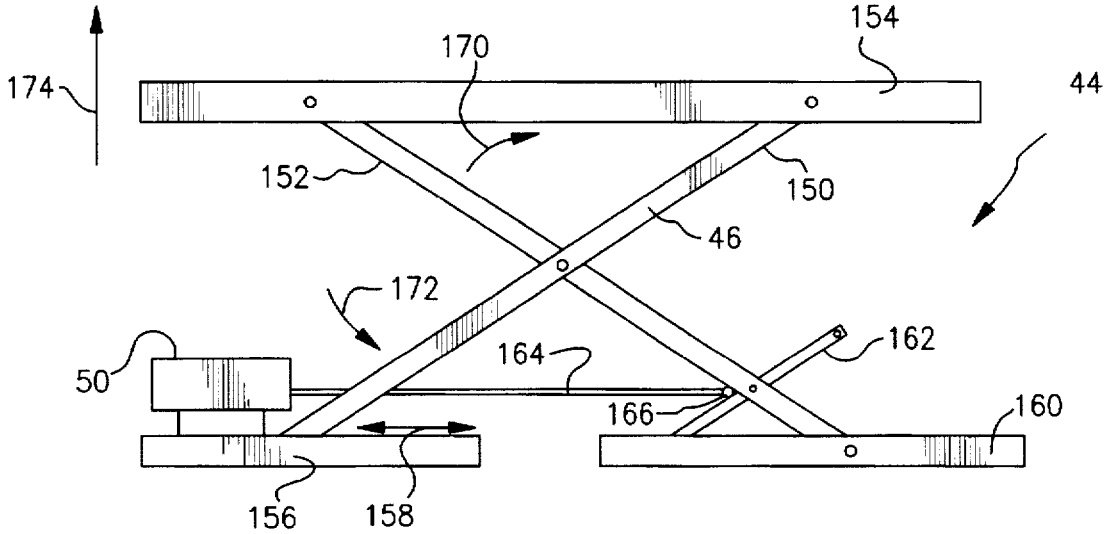
FIG. 10 is an elevational front view of still another preferred lift apparatus.

An additional view of a preferred scissor jack 44 is provided in FIG. 10. Each of the scissor components 44 and 46 includes a pair of pivotally interconnected elongate elements 150 and 152. The upper ends of elements 150 and 152 are themselves pivotally connected to an upper lift frame component 154. The platform, not shown in FIG. 10, is mounted to frame component 154. The opposite lower end of element 150 is slidably received in a channel 156. As a result, the lower end of element 150 may be slid back and forth in channel 156 as indicated by double-headed arrow 158. The lower end of element 152 is pivotally interconnected in a base channel 160. A relatively short element 162 is slidably received in channel 160 and pivotally connected to elongate element 152. This structure applies to both of the scissor components 46 and 48. In FIG. 1, a single forward channel receives scissor component 44 and forward pivot element 162; similarly, a single rearward channel receives the rearward scissor component 48 and its associated channel 162.

Motor 50 selectively extends and retracts an elongate actuator arm 164 in the manner indicated by double-headed arrow 158. A transverse component 166, see also FIG. 1, is carried at the distal end of arm 164. Component 166 engages the crux of elements 162 and 152. The transverse component engages both of scissor components 46 and 48 in this manner. Accordingly, as arm 164 is extended, element 152 is urged upwardly in the direction of arrow 170; element 150 is likewise pivoted in the direction of arrow 172. This elevates the lift so that the platform is raised in the direction of arrow 174. Retracting arm 164 lowers lift 44. Again, the described scissor jacks are illustrative only. Various other types of lifts may be used to raise and lower the platform. In the lift of FIG. 2, a number of the above components are omitted for clarity. The lift may be operated in a analogous manner or in some other conventional fashion that will be understood to those skilled in art.

Figure 11:
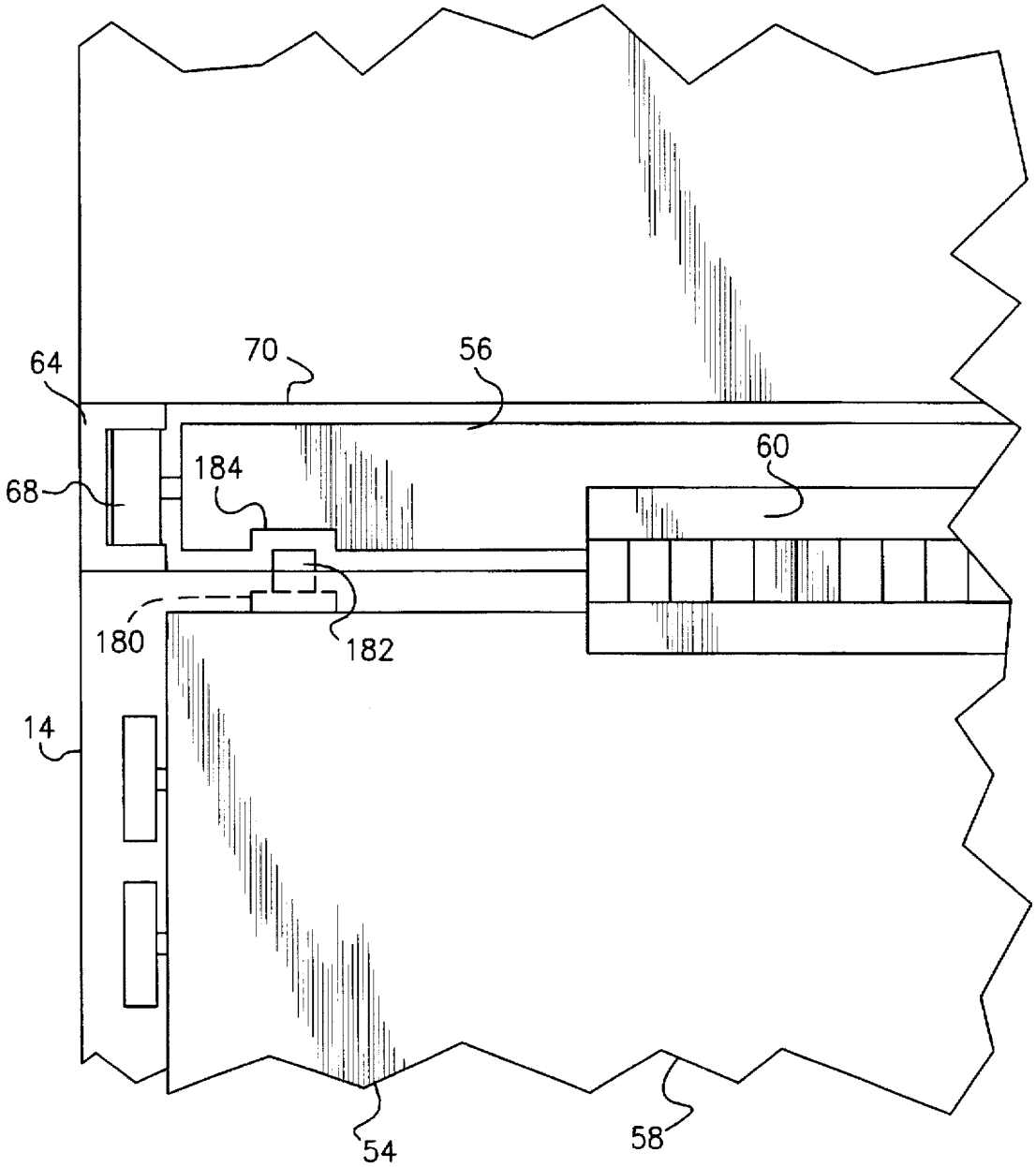
FIG. 11 is an elevational view of the closure in its removed, open condition and the limit switch, which prevents the lift from raising when the closure is interposed between the upper and lower housing sections.

Closure 54 is depicted in an open condition in FIG. 11. Forward member 56 is located proximate slot 70 and rearward member 58 pivotally depends from member 56 outside of the housing. A limit switch 180 is mounted within lower housing section 14 just below slot 70. The limit switch may be installed in lower section 14 in any suitable manner. The switch has an actuator button 182 that extends slightly into slot 70. The limit switch is connected in a known manner to the lift circuit. In a disengaged state, the limit switch has no effect on operation of the lift. However, when actuator button 182 is engaged, the limit switch deactivates the lift circuit. As a result, the lift cannot be raised.

Forward member 56 of closure 54 includes a recess 184 that is located such that it corresponds with the position of limit switch 180 when the closure is in the position shown in FIG. 11. In particular, recess 184 accommodates actuator button 182 so that switch 180 is not engaged when the closure is pulled out of the housing and forward member 56 is located in slot 70. On the other hand, the lower surface of member 58 does not include a recess resembling recess 184. When the closure is fully interposed between the upper and lower sections of the housing by pivoting member 58 upwardly and inserting member 58 into the housing through slot 70, the lower surface of member 58 engages actuator button 182. This causes switch 180 to deactivate the lift circuit. Even if rocker switch 84 is switched into an operational position, the lift cannot be raised. As a result, accidental damage to merchandise carried on platform 42 is avoided.

Figure 6:
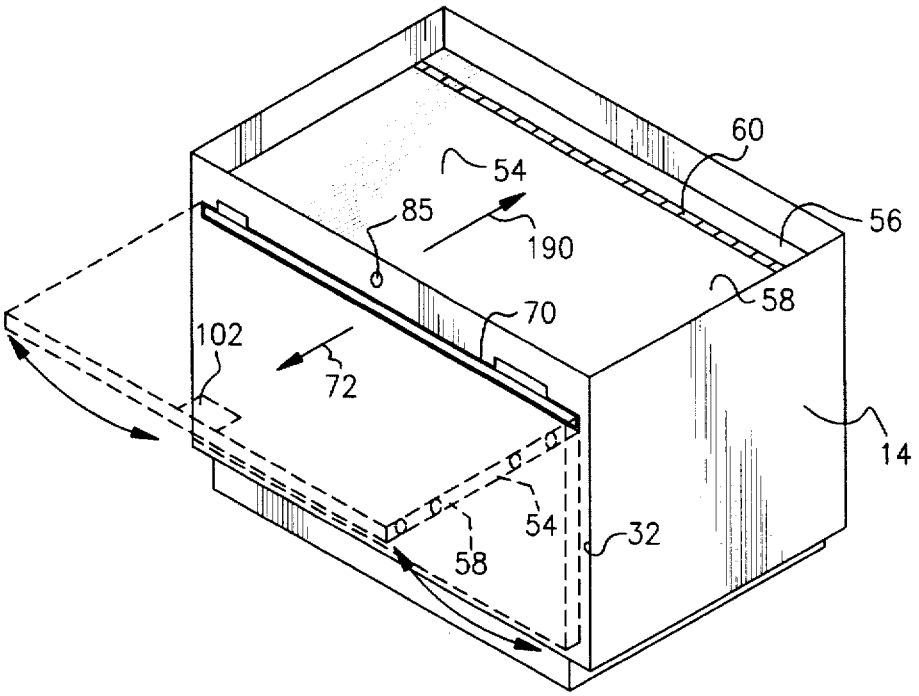
FIG. 6 is perspective view of the lower section of the display case illustrating the closure in its interposed and removed positions.

In operation, during business hours, jewelry or other merchandise is normally displayed within case 10. To prepare the case for display, closure 54 is pulled into its open condition. Specifically, lock 85 is opened so that the closure is released. Pull handle 100 is grasped and the closure is pulled rearwardly from the case in the direction of arrow 72. The closure rolls smoothly along the tracks by means of rollers 66 and 68. When the closure member 58 is fully drawn out of the housing, as shown in FIGS. 6 and 7, it is allowed to pivot downardly and against the outside of the case. The merchant or salesperson operates lock 82 to energize the case (this may be done initially). Rocker switch 84 is operated to activate motor 50 so that lift 44 raises platform 42 from the position shown in FIGS. 1, 2 and 3 into the position shown in phantom in FIG. 3 as well as in FIG. 9. Because the actuator button 182 of limit switch 180 is received by recess 184 in closure member 56, the lift is permitted to freely operate. Merchandise carried on the platform is displayed during the business day through upper display section 16.

After the business closes for the day, the platform 42 and displayed merchandise 52 are quickly, automatically and securely lowered into storage section 14. The retailer or salesperson presses or otherwise actuates switch 84 into the lowering mode, which causes motor 50 to reverse direction. As a result, arm 164, FIG. 10, is shortened. Elements 150 and 152 of scissor components 46 and 48 collapse so that the lift and the platform are lowered within housing 12. Specifically, the lift and platform return to the condition shown in FIGS. 1–3. Closure member 58 is then pivotally raised so that it is generally coplanar with closure member 56. The entire closure 54 is reinserted into housing 12, in the direction of arrow 190, until the leading edge of member 56 is received in recess 94 and closure 54 is fully interposed between lower housing section 14 and upper housing section 16. See, in particular, FIGS. 1 and 6. The retailer then uses an appropriate key to operate lock 85 so that it engages latch 102 in closure member 58. This locks the closure member securely in the closed position. The platform and merchandise supported thereon are fully enclosed within lower section 14. The opaque walls of the lower housing section and the closure hide the merchandise from view. As an added precaution, the impact resistant construction of the locked closure and the metal lined exterior walls of the lower housing section housing help to prevent a would-be thief from breaking in through the lower storage section of the housing and removing the contents secured therein. In the closed condition, the metal guard 106, FIGS. 5 and 5A, blocks access through slot 70 to the lock 85 and latch 102.

When closure member 58 is reinserted into slot 70, the lower surface of that closure member engages limit switch 180 in the manner previously described. As a result, even if switch 84 is engaged to actuate the elevated mode, the lift circuit is disabled. This prevents the platform and the merchandise supported thereon from being driven against the locked closure. Possible damage to the merchandise, as well as to the lift motor, is thereby averted. The lift may also be disabled by deactivating motor 50 through switch lock 82.

At the beginning of each business day the closure is unlocked and pulled out of the housing. The lift and stored merchandise are then raised for display. Each evening the process is reversed. In this manner, merchandise is safely and securely stored with the display cases during after-business hours. The case does not have to be emptied and refilled on a daily basis. The need for a separate safe or vault is also eliminated.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A theft-resistant display case comprising:

a housing that includes a lower storage section having an obscuring exterior wall and a substantially fully enclosable upper display section mounted above said lower section and having transparent front and upper walls;

a platform movably mounted within said housing for supporting items to be displayed;

means for selectively raising said platform into a first position in said housing, wherein items supported on said platform are displayed in said upper section of said housing, and lowering said platform into a second position in said housing wherein items supported on said platform are stored in said lower section of said housing; and an obscuring closure that is selectively interposed between said upper and lower sections when said platform is in said second position, whereby said platform and items supported thereon are enclosed within said lower section of said housing and hidden from view.

2. The case of claim 1 further including means supporting said closure in an interposed condition between said upper and lower sections and for permitting said closure to be at least partly removed from between said upper and lower sections and held beneath said upper section so that said lower section is exposed.

3. The case of claim 2 in which said housing includes a slot through which said closure is selectively interposed and at least partly removed from between said upper and lower sections of said housing.

4. The case of claim 3 in which said closure includes hingedly interconnected forward and rearward members that are selectively alternatable between a substantially coplanar condition wherein said closure may be interposed through said slot between said upper and lower sections of said housing and a second, angled condition wherein said rearward closure member is removed through said slot from between said upper and lower sections of said housing and pivoted downwardly relative to said forward member into a position against said exterior wall of said lower section of said housing.

5. The case of claim 4 in which said means for removably supporting include two sets of rollers carried by one of said closure and said housing and two tracks carried by the other of said closure and said housing; each track being operably engaged with a respective set of rollers such that said closure is selectively interposed and removed from between said upper and lower sections.

6. The case of claim 5 in which said tracks are mounted to said housing along respective sides of said closure and wherein said two sets of rollers are carried by said forward and rearward closure members along respective sides of said closure.

7. The case of claim 4 further including a lock mounted in said housing above said slot and wherein said rearward member of said closure carries a latch that is selectively engaged by said lock to hold said closure in the interposed condition.

8. The case of claim 7 further including a plate carried by said rearward closure member, said plate blocking access to said lock through said slot when said closure is in said interposed condition.

9. The case of claim 1 further including means for locking said closure in said interposed condition.

10. The case of claim 1 further including switch means that are responsive to said closure being interposed between said upper and lower sections of said housing for preventing said platform from being raised.

11. The case of claim 1 further including flexible sweep means interengaging said platform and said housing for preventing items supported on said platform from passing between said platform and said housing and for permitting said platform to be raised and lowered within said housing.

12. The case of claim 1 in which said means for raising and lowering include an electrically powered lift apparatus contained within said lower section of said housing.

13. The case of claim 1 in which said lower section of said housing includes an outer shell and an inner liner that is less penetrable than said outer shell to reduce access into said lower section.

14. A theft-resistant display case comprising:

a housing that includes a lower storage section having an obscuring exterior wall and an upper display section mounted above said lower section and having an exterior wall that is at least partly transparent;

a platform movably mounted within said housing for supporting items to be displayed;

means for selectively raising said platform into a first position in said housing, wherein items supported on said platform are displayed in said upper section of said housing, and lowering said platform into a second position in said housing wherein items supported on said platform are stored in said lower section of said housing;

an obscuring closure that is selectively interposed between said upper and lower sections when said platform is in said second position, whereby said platform and items supported thereon are enclosed within said lower section of said housing and hidden from view; and means supporting said closure in an interposed condition between said upper and lower sections and permitting said closure to be at least partly removed from between said upper and lower sections so that said lower section is exposed, said housing including a slot through which closure is selectively interposed and at least partly removed from between said upper and lower sections of said housing.

15. The case of claim 14 in which said closure includes hingedly interconnected forward and rearward members that are selectively alternatable between a substantially coplanar condition wherein said closure may be interposed through said slot between said upper and lower sections of said housing and a second, angled condition wherein said rearward closure member is removed through said slot from between said upper and lower sections of said housing and pivoted downwardly relative to said forward member into a position against said exterior wall of said lower section of said housing.

16. The case of claim 15 in which said means for removably supporting include two sets of rollers carried by one of said closure and said housing and two tracks carried by the other of said closure and said housing; each track being operably engaged with a respective set of rollers such that said closure is selectively interposed and removed from between said upper and lower sections.

17. The case of claim 16 in which said tracks are mounted to said housing along respective sides of said closure and wherein said two sets of rollers are carried by said forward and rearward closure members along respective sides of said closure.

18. The case of claim 15 further including a lock mounted in said housing above said slot and wherein said rearward member of said closure carries a latch that is selectively engaged by said lock to hold said closure in the interposed condition.

19. The case of claim 18 further including a plate carried by said rearward closure member, said plate blocking access to said lock through said slot when said closure is in said interposed condition.

20. A theft-resistant display case comprising:

a housing that includes a lower storage section having an obscuring exterior wall and an upper display section mounted above said lower section and having an exterior wall that is at least partly transparent;

a platform movably mounted within said housing for supporting items to be displayed;

means for selectively raising said platform into a first position in said housing, wherein items supported on said platform are displayed in said upper section of said housing, and lowering said platform into a second position in said housing wherein items supported on said platform are stored in said lower section of said housing;

an obscuring closure that is selectively interposed between said upper and lower sections when said platform is in said second position, whereby said platform and items supported thereon are enclosed within said lower section of said housing and hidden from view; and switch means that are responsive to said closure being interposed between said upper and lower sections of said housing for preventing said platform from being raised.

* * * * *